US007128637B2

(12) United States Patent
Kim et al.

(10) Patent No.: US 7,128,637 B2
(45) Date of Patent: Oct. 31, 2006

(54) SYSTEM AND METHOD DETECTING MALFUNCTION OF PAD CONDITIONER IN POLISHING APPARATUS

(75) Inventors: Hyeung-Yeul Kim, Suwon-si (KR); Sung-Hwan Kim, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/207,765

(22) Filed: Aug. 22, 2005

(65) Prior Publication Data

US 2006/0052036 A1 Mar. 9, 2006

(30) Foreign Application Priority Data

Sep. 9, 2004 (KR) ..... 10-2004-0071967

(51) Int. Cl.
*B24B 53/00* (2006.01)

(52) U.S. Cl. ..... 451/5; 451/443; 451/56

(58) Field of Classification Search ..... 451/5, 451/6, 443, 444, 56, 72, 8
See application file for complete search history.

(56) References Cited

U.S. PATENT DOCUMENTS 5,833,519 A * 11/1998 Moore ..... 451/56
5,904,608 A 5/1999 Watanabe
5,975,994 A * 11/1999 Sandhu et al. ..... 451/56
6,695,680 B1 2/2004 Choi et al.
6,953,382 B1 * 10/2005 Korovin et al. ..... 451/5

* cited by examiner

*Primary Examiner*—Robert A. Rose
(74) *Attorney, Agent, or Firm*—Volentine Francos & Whitt, PLLC

(57) ABSTRACT

A system and method adapted to detect a malfunction related to a pad conditioner in a polishing apparatus are disclosed. The pad conditioner includes a conditioning pad seated on a conditioner head and a drive motor rotating the conditioner head. The system also comprises a current sensor connected to the drive motor, adapted to detect electrical current drawn by the drive motor, and provide a corresponding current value, a Personal Computer (PC) receiving the current value, adapted to compare the received current value to first and second reference values, and generate a drive indication signal in response to the comparison, and a main controller receiving the drive indication signal and adapted to generate an interlock signal halting operation of the polishing apparatus in response to the drive indication signal.

18 Claims, 4 Drawing Sheets

SYSTEM AND METHOD DETECTING MALFUNCTION OF PAD CONDITIONER IN POLISHING APPARATUS

BACKGROUND OF THE INVENTION

1. Technical Field

The present invention generally relates to a polishing apparatus (or system) useful in the fabrication and processing of semiconductor wafers. More particularly, the invention relates to a device and related method adapted to detect a malfunction related to a pad conditioner in the polishing apparatus.

This application claims the benefit of Korean Patent Application No. 10-2004-0071967, filed Sep. 9, 2004, the disclosure of which is hereby incorporated by reference in its entirety.

2. Discussion of Related Art

The typical sequence of processes used to manufacture semiconductor devices is a long and complicated one. Many individual semiconductor devices are manufactured on a single substrate. This substrate is usually provided in the form of a thin wafer of semiconductor material.

Over time, semiconductor devices have been formed a wafer with ever increasing height profiles. Increased height profiles result from higher integration densities and increased use of multi-layer structures. These interconnected multi-layer structures are generally formed layer by layer. To accomplish this, multiple planarization processes are performed prepare an upper surface of one structure or layer to receive another structure or layer.

A great variety of conventional, wafer planarization processes exist, including as examples, spin on glass (SOG), etch back, and reflow. Many of these processes include mechanical polishing and/or chemical polishing. Chemical and mechanical polishing has respective advantages and disadvantages. For example, a chemical polishing is preferred where a mechanical polishing might damage (e.g., grind) a delicate surface. However, it is often difficult to obtain a truly flat surface (e.g., an accurate topology) using only chemical polishing.

So, conventionally, some mix of mechanical polishing and chemical polishing has been required to accurately planarize a surface. In fact, the mutual presence of both chemical and mechanical polishing in conventional planarization processes is commonly referred to as Chemical-Mechanical-Polishing (CMP).

There are many types and variations of conventional CMP processes. Several examples are described here.

CMP is conducted at a polishing table. A wafer is attached to a polishing head using surface tension or vacuum pressure. A rotating polishing pad provided at the polishing table is forced into contact with the wafer under constant force. The pad rotation and the resulting forcible agitation polish the wafer. That is, using the weight of the polishing head and the applied force, the wafer surface and the polishing pad come into contact. The resulting plane of contact is typically washed with a slurry of polishing solution containing grinding particles and/or polishing agents (e.g., chemicals). The grinding slurry serves to remove polishing debris and grinding particles and supply polishing agents to the surface.

One example of a conventional polishing apparatus is found in U.S. Pat. No. 5,975,994.

A similar conventional polishing apparatus is illustrated on Figure (FIG.) 1. Within this apparatus, a wafer 12 is vacuum attached to a polishing head 10 which is attached to rotatable motor 26. A platen 20 attaching a polishing pad 16 is rotated in a direction contrary to the rotation direction of motor 26. Polishing head 10 is lowered until the facing surface of wafer 12 contacts polishing pad 16 while a slurry is supplied. A conditioning disc 24 driven by a motor 28 and attaching a conditioning pad 22 is typically provided as part of the foregoing polishing apparatus. Conditioning pad 22 is applied to polishing pad 16 in order to maintain a proper (e.g., planar) surface.

Polishing apparatuses like the one shown in FIG. 1 have been widely used in the industry for many years with excellent results. However, one notable exception to this excellent track record is reoccurring problems with a conditioning pad installed in opposition to the platen. Such conditioning pads have a frequent rate of malfunction. This frequent state of malfunction can cause larger problems, because if the conditioning pad is not regularly applied to the polishing pad (typically before and/or after each polishing process) problems arise, such as inadequate polishing rates and degraded polishing uniformity. These results threaten the reliability of semiconductor devices formed on the wafer.

SUMMARY OF THE INVENTION

Embodiments of the invention are directed a polishing apparatus and method of use in which malfunctions related to a conditioning pad are detected and associated degradation in polishing uniformity and wafer defects are avoided accordingly.

Thus, in one embodiment, the invention provides a system adapted to detect a malfunction related to a pad conditioner in a polishing apparatus, wherein the pad conditioner comprises a conditioning pad seated on a conditioner head, and a drive motor rotating the conditioner head, wherein the system comprises, a current sensor connected to the drive motor, adapted to detect electrical current drawn by the drive motor, and provide a corresponding current value, a Personal Computer (PC) receiving the current value, adapted to compare the received current value to first and second reference values, and generate a drive indication signal in response to the comparison, and a main controller receiving the drive indication signal and adapted to generate an interlock signal halting operation of the polishing apparatus in response to the drive indication signal.

The current sensor may comprise an analog/digital (A/D) converter adapted to provide the current value in a digital form.

The system may also comprise an alarm and/or a display.

Thus, in one related aspect, the main controller may be further adapted to display a message on the display upon generating the interlock signal.

In another aspect, the system may further comprise a communication link connecting the current sensor and the PC and adapted to transmit the current value. This communication link may be one or more of a wireless link, an infrared link, and an Ethernet link.

In another embodiment, the invention provides a method of detecting a malfunction related to a pad conditioner in a polishing apparatus, wherein the pad conditioner comprises a conditioning pad seated on a conditioner head, and a drive motor rotating the conditioner head, wherein the method comprises; sensing drive current drawn from a power source coupled to the drive motor, converting the sensed current into a digital current value, comparing the digital current value to a first reference value, and providing a drive indication signal in response to the comparison.

In a related aspect, the method may further comprise providing an interlock signal halting operation of the polishing apparatus in responsive to the drive indication signal.

The drive indication signal may indicate an OFF condition for the drive motor if the digital current value is less than the first reference value, or an ON condition for the drive motor if the digital current value is greater than a second reference value.

In yet another embodiment, the invention provides a method of detecting a malfunction related to a pad conditioner in a polishing apparatus, wherein the pad conditioner comprises a conditioning pad seated on a conditioner head, and a drive motor rotating the conditioner head, wherein the method comprises; sensing drive current drawn from a power source coupled to the drive motor, converting the sensed current into a digital current value, communicating the digital current value to a Personal Computer (PC), comparing the digital current value to first and second reference values stored in the PC, and providing a drive indication signal in response to the comparisons.

BRIEF DESCRIPTION OF THE DRAWINGS

Embodiments of the invention will be described with reference to the accompanying drawings in which.

DETAILED DESCRIPTION OF EXEMPLARY EMBODIMENT(S)

The present invention will now be described in some additional detail with reference to one or more embodiments(s) shown in the accompanying drawings.

Figure 1:
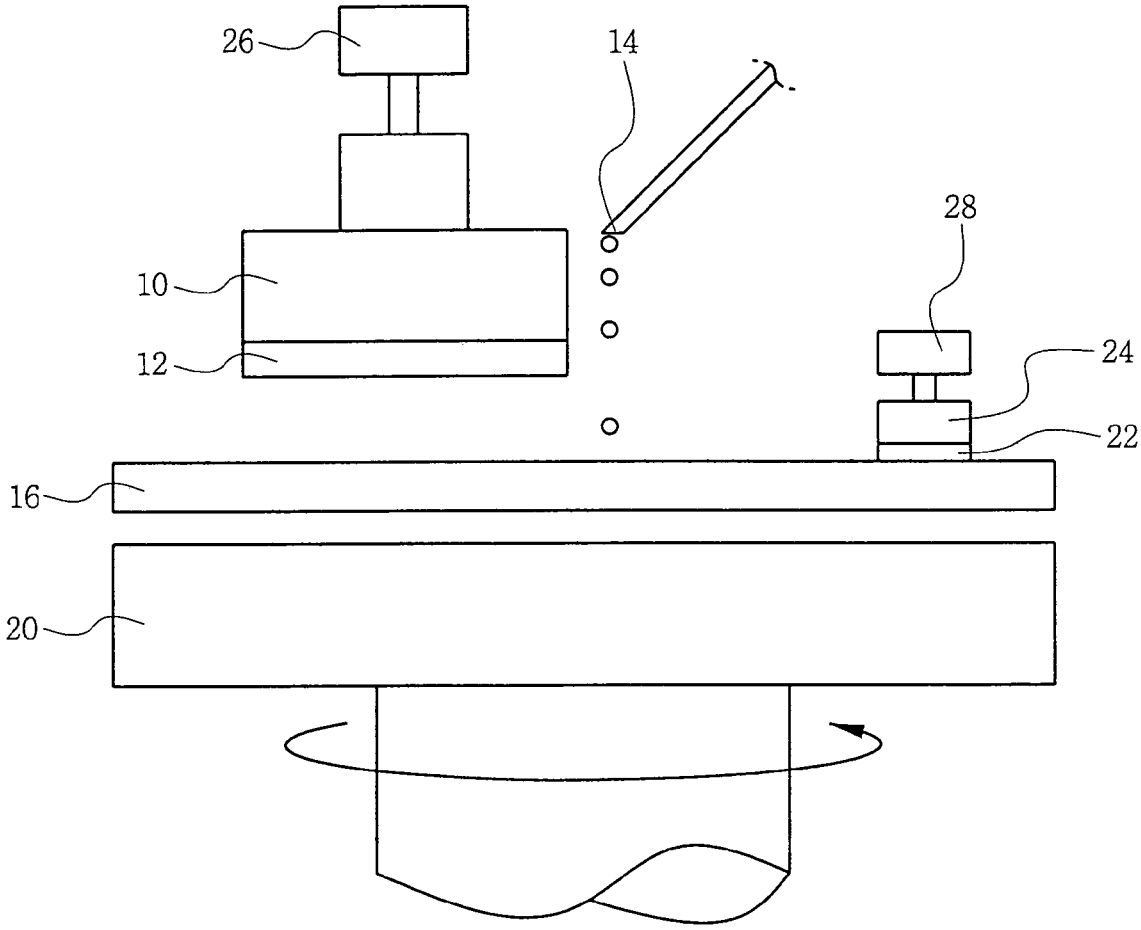
FIG.1 (PRIOR ART)
FIG. 1 is a system diagram of a conventional polishing apparatus for semiconductor wafer.
Figure 2:
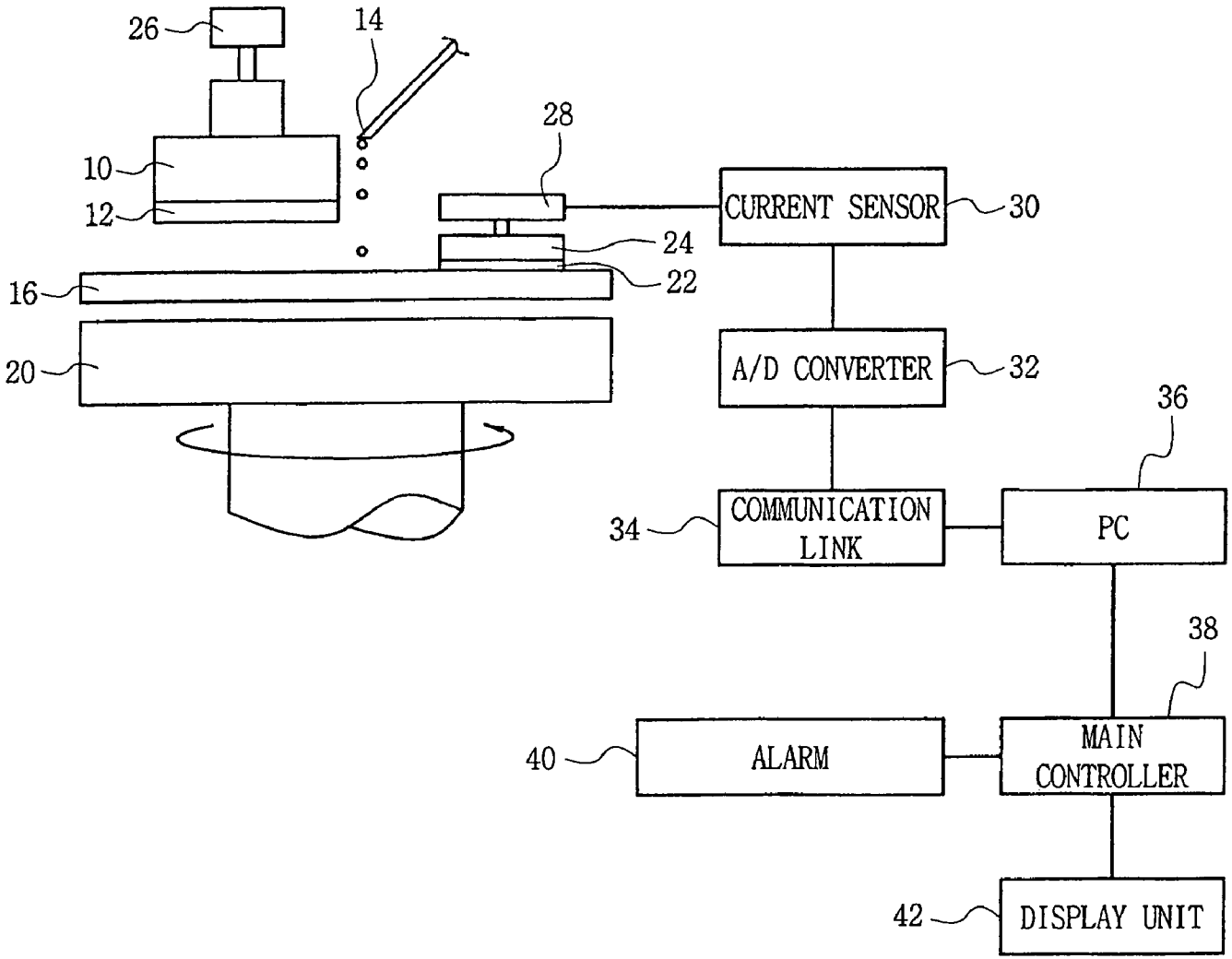
FIG. 2 is a system diagram of one embodiment of a polishing apparatus for semiconductor wafer according to the present invention.

FIG. 2 is a system diagram of a polishing apparatus for semiconductor wafer according to the present invention.

The polishing apparatus generally comprises: a polishing pad 16 for polishing a wafer 12; a platen 20 for fixing (e.g., seating) and rotating polishing pad 16; and a polishing head 10 installed in counterpoise to polishing pad 16. Wafer 12 is seated on polishing head 10 by means of vacuum. The polishing apparatus also comprises a motor 26 adapted to rotate polishing head 10.

Additionally, the polishing apparatus comprises a pad conditioner comprising a conditioning pad 22 adapted to condition polishing pad 16 and seated on a conditioner head 24. Conditioning pad 22 is also provide in counterpoise to polishing pad 16. A drive motor 28 is coupled to conditioner head 24 and is adapted to rotate conditioner head 24 by drawing electrical current from a power supply (not shown).

A current sensor 30 adapted to sense (e.g., detect or measure) the amount of electrical current drawn by current sensor 30 is connected to drive motor 28. An analog/digital (A/D) converter 32 may be separately provided in conjunction with current sensor 30, or may be integral to current sensor 30. However, physically provided A/D converter 32 generally converts an analog current value derived by current sensor 30 into a digital current value.

This digital current value is well suited for communication via a communication link (e.g., an Ethernet connection, a wireless link, or an infrared link) to a computational platform, such as a Personal Computer (PC) 36. Once received in the computational platform, the digital current value may be compared with defined threshold values (e.g., reference values) indicative of system operation. For example, PC 36 may store one or more reference values to-be-compared with the received digital current value. Based on comparison results between the digital current value and the one or more reference values, PC 36 generates a drive indication signal indicating the current operating state for drive motor 28 in relation to the defined threshold values.

Figure 3:
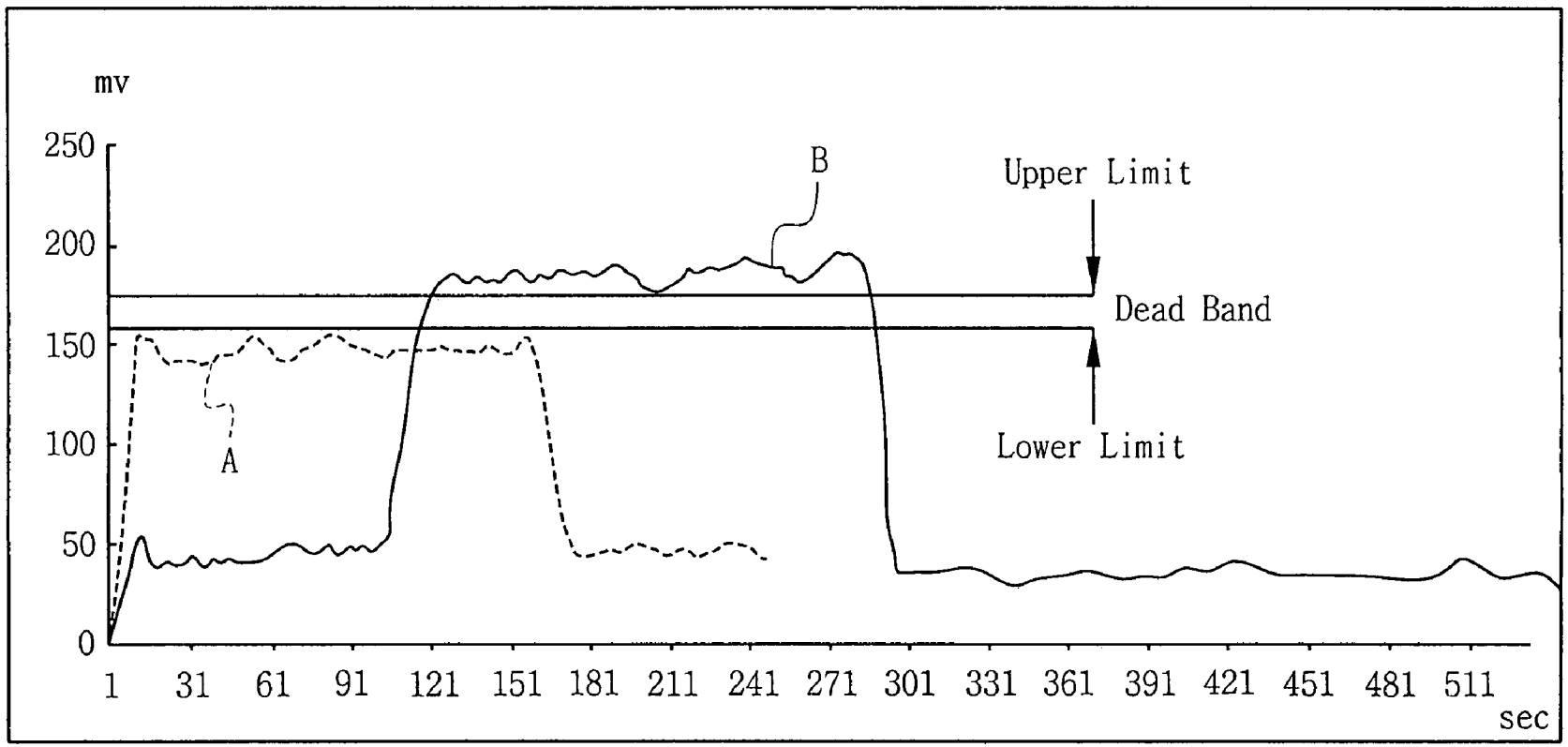
FIG. 3 is a graph showing a waveform derived from experimental data measuring drive current for motor 28 shown in FIG. 2.
Figure 4:
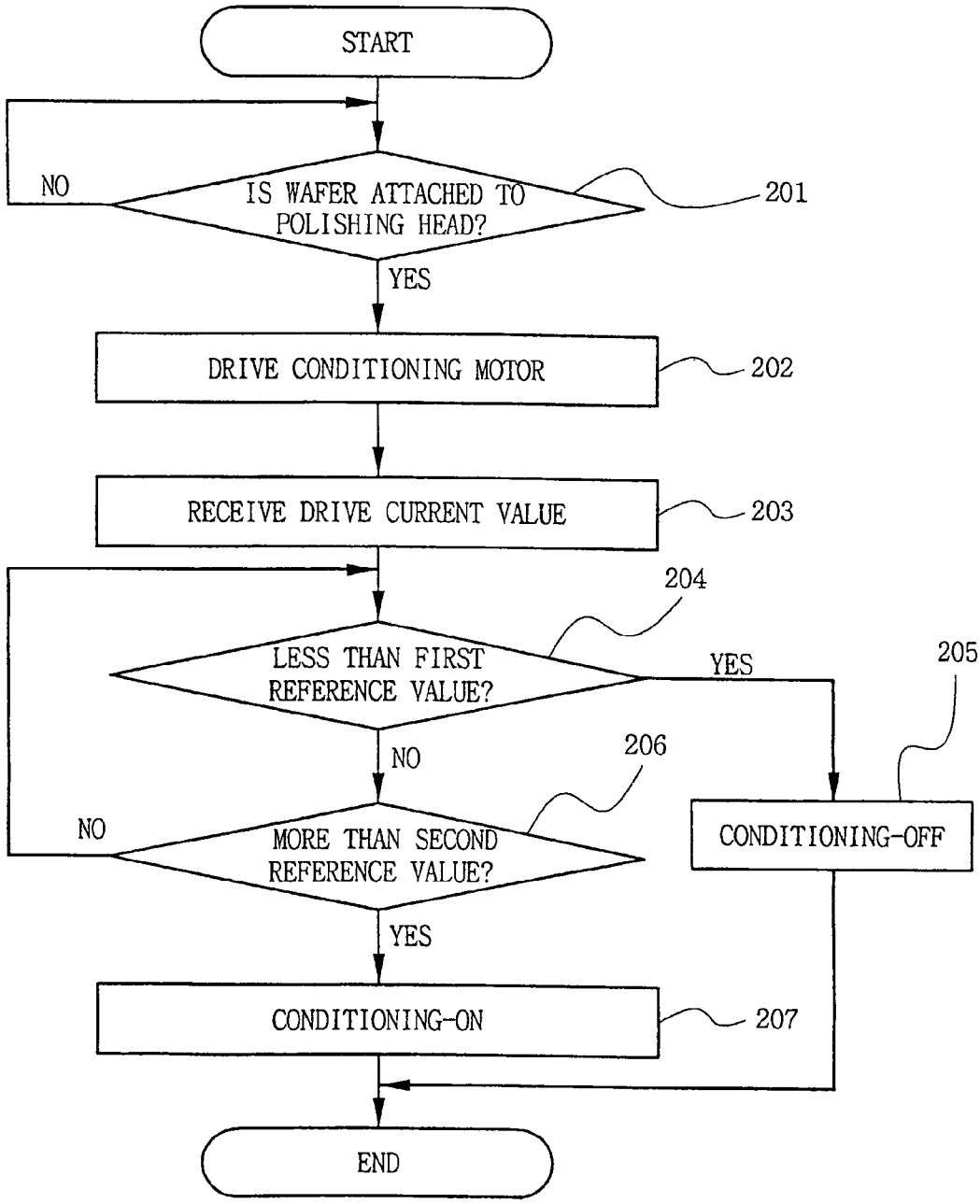
FIG. 4 is a control flow chart illustrating an exemplary control method adapted for use with motor 28 shown in FIG. 2.

The polishing apparatus may further comprises a main controller 38 receiving the drive indication signal from PC 36, and conditionally generating an interlock signal to halt operation of the polishing apparatus. An alarm 40 and/or a message display 42 may be associated with main controller 38. FIG. 3 is a graph illustrating experimentally derived current-related data for drive motor 28 in accordance with one embodiment of the present invention. FIG. 4 is a control flow chart adapted for use in a method for sensing of an operating malfunction related to drive motor 28 according to the present invention.

An exemplary operating flow and related method of operation will now be described in some additional detail with reference to one embodiment of the invention with reference to FIGS. 2, 3, and 4.

With reference to FIG. 4, a determination is first made as to whether wafer 12 is seated on polishing head 10 (201). Once wafer 12 is seated, drive motor 28 is turned "ON" (202). Once, an electrical current is applied to drive motor 28, current sensor 30 will begin to sense drive current drawn from the drive power source (not shown). Once drive motor 28 is up to speed, current sensor 30 will sense (e.g., detect) in analog form the amount of current being drawn. This analog current value is then preferably converted to digital form using AND converter 32.

The resulting digital current value may then be communicated via communication link 34 to PC 36 (203). PC 36 receives the digital current value and compares it to at least one of first and second predetermined reference values (204, 206). In the example in FIG. 3, the first reference value is about 50 mA, and the second reference value is about 60 mA. In this regard, the first reference value corresponds to a first characteristic voltage value (as indicated during an idling mode of operation for drive motor 28—see graph section "A") of around 160 mV (based on a typical I to V conversion), and the second reference value similarly corresponds to a second characteristic voltage value of around 196 mV (as indicated during a conditioning idling mode of operation for drive motor 28—see graph section "B").

Following a comparison within PC 36 of the digital current value with the first reference value (204), a drive indication signal may be generated indicating an "OFF" condition for drive motor 28 where the sensed current remains below a threshold (e.g., first limit) established in relation to the first reference value (205). Main controller 38 thus receives a clear indication of the true operating conditions of the pad conditioner. In response, main controller 38 may generate an interlock signal halting or precluding operation of the polishing apparatus, and/or issuing an alarm and/or causing an alarm message to be displayed.

However, if the sensed current exceeds the first threshold, a second comparison is then made in relation to a second threshold established in relation to second reference value (206). That is, PC 36 checks whether the digital current value received through the communicating link 34 is greater than the second reference value. Where the sensed current also exceeds the second reference value, the drive indication signal indicates a normal operating condition (207). This operating condition may then be transmitted to main controller 38 which may then controls the polishing apparatus to normally conduct a conditioning process.

In one possible mode of operation for the polishing apparatus, platen 20 on which polishing pad 16 is attached is rotated in one direction as it is applied to wafer 12 and conditioner head 24 is rotated in the opposite direction. Conditioner head 24 having conditioning pad 22 seated thereon may thus be lowered to come into contact with polishing pad 16 in the presence of a polishing slurry. In this manner and with this arrangement, polishing pad 16 may be conditioned through application of conditioning pad 22.

Of note, main controller 38 accurately detects the polishing (e.g., grinding) state for polishing pad 16 and may therefore control the polishing process and related conditioning process to ensure even wear and application of the polishing pad. That is, the rotation speed of conditioner head 24 may be controlled such that if the surface of polishing pad 16 is irregular, the rotation speed is increased, and if it is even, the rotation speed is decreased. This ability helps prevent the development of an irregular surface on polishing pad 16.

In the illustrated embodiment of the invention, a current sensor is coupled to a power supply connected to drive motor 28 in order to sense supply current, supply current being indicative of the operating state (and related malfunctions) for drive motor 28. However, in another embodiment of the invention, a voltage sensor might be installed instead of a current sensor. Similar modifications and alterations will suggest themselves to one of ordinary skill in the art.

As described before, the present invention provides a method and apparatus for upon polishing a wafer and has application in a larger semiconductor manufacturing process. By sensing malfunctions related to a conditioning pad, a wafer polishing apparatus according to the present invention prevents the development of a range of wafer defects and polishing uniformity problems, thereby increasing manufacturing yield.

The invention has been described in the context of several exemplary embodiments. However, it is to be understood that the scope of the invention is not limited to only the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A system adapted to detect a malfunction related to a pad conditioner in a polishing apparatus, wherein the pad conditioner comprises a conditioning pad seated on a conditioner head, and a drive motor rotating the conditioner head, wherein the system comprises:

a current sensor connected to the drive motor, adapted to detect electrical current drawn by the drive motor, and provide a corresponding current value;

a Personal Computer (PC) receiving the current value, adapted to compare the received current value to first and second reference values, and generate a drive indication signal in response to the comparison; and a main controller receiving the drive indication signal and adapted to generate an interlock signal halting operation of the polishing apparatus in response to the drive indication signal.

2. The system of claim 1, wherein the current sensor comprises an analog/digital (A/D) converter adapted to provide the current value in a digital form.

3. The system of claim 2, further comprising an alarm; and, wherein the main controller is further adapted to actuate the alarm upon generating the interlock signal.

4. The system of claim 2, further comprising a display; and, wherein the main controller is further adapted to display a message on the display upon generating the interlock signal.

5. The system of claim 2, further comprising:

a communication link connecting the current sensor and the PC and adapted to transmit the current value.

6. The system of claim 5, wherein the communication link comprises at least one of a wireless link, an infrared link, and an Ethernet link.

7. The system of claim 2, wherein the first reference value is 50 mA, and the second reference value is 60 mA.

8. The system of claim 7, wherein the PC upon determining that the current value is less than the first reference value, generates a negative drive indication signal; and, upon determining that the current value is greater than the second reference value, generating a positive drive indication signal.

9. A method of detecting a malfunction related to a pad conditioner in a polishing apparatus, wherein the pad conditioner comprises a conditioning pad seated on a conditioner head, and a drive motor rotating the conditioner head, wherein the method comprises:

sensing drive current drawn from a power source coupled to the drive motor, and converting the sensed drive current into a digital current value;

comparing the digital current value to a first reference value and a second reference value; and, providing a drive indication signal in response to the comparison, wherein the drive indication signal indicate an ON condition for the drive motor if the digital current value is greater than the second reference value.

10. The method of claim 9, further comprising:

providing an interlock signal halting operation of the polishing apparatus in responsive to the drive indication signal.

11. The method of claim 10, wherein the drive indication signal indicates an OFF condition for the drive motor if the digital current value is less than the first reference value.

12. A method of detecting a malfunction related to a pad conditioner in a polishing apparatus, wherein the pad conditioner comprises a conditioning pad seated on a conditioner head, and a drive motor rotating the conditioner head, wherein the method comprises:

sensing drive current drawn from a power source coupled to the drive motor;

converting the sensed current into a digital current value;

communicating the digital current value to a Personal Computer (PC);

comparing the digital current value to first and second reference values stored in the PC:

providing a drive indication signal in response to the comparisons.

13. The method of claim 12, wherein the digital current value is communicated to the PC via at least one of a wireless link and an Ethernet link.

14. The method of claim 13, further comprising:

generating an interlock signal halting operation of polishing apparatus in response to the drive indication signal.

15. The method of claim 14, further comprising:

actuating an alarm in response to the drive indication signal.

16. The method of claim 15, wherein the drive indication signal indicates an OFF condition for the drive motor if the digital current value is less than the first reference value.

17. The method of claim 16, wherein the drive indication signal indicates an ON condition for the drive motor if the digital current value is greater than the second reference value.

18. The method of claim 15, further comprising:

displaying a message on a display in response to the drive indication signal.

* * * * *